US009874340B2

(12) United States Patent
Chien

(10) Patent No.: US 9,874,340 B2
(45) Date of Patent: Jan. 23, 2018

(54) LED LIGHT HAS ELECTRIC COIL-MEANS AND MAGNETIC-MEANS

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 14/149,092

(22) Filed: Jan. 7, 2014

(65) Prior Publication Data

US 2015/0192283 A1 Jul. 9, 2015

(51) Int. Cl.

| | |
|---|---|
| ***F21S 10/04*** | (2006.01) |
| ***F21S 10/00*** | (2006.01) |
| ***F21V 23/02*** | (2006.01) |
| ***F21V 33/00*** | (2006.01) |
| *F21W 121/00* | (2006.01) |
| *F21Y 115/10* | (2016.01) |

(52) U.S. Cl.

CPC ..... *F21V 23/02* (2013.01); *F21S 10/00* (2013.01); *F21S 10/046* (2013.01); *F21V 33/0052* (2013.01); *F21V 33/0056* (2013.01); *F21W 2121/00* (2013.01); *F21Y 2115/10* (2016.08)

(58) Field of Classification Search

CPC .. F21V 23/02; F21V 33/0052; F21V 33/0056; F21S 10/00; F21S 10/046

See application file for complete search history.

(56) References Cited

U.S. PATENT DOCUMENTS

| | | | | |
|---|---|---|---|---|
| 4,551,794 | A * | 11/1985 | Sandell | F21S 6/001 362/392 |
| 7,832,917 | B2 * | 11/2010 | Chien | F21S 8/035 362/641 |
| 8,070,319 | B2 * | 12/2011 | Schnuckle | F21S 10/04 362/249.02 |
| 2012/0105814 | A1 * | 5/2012 | Chien | G03B 21/20 353/85 |

* cited by examiner

*Primary Examiner* — Anh Mai
*Assistant Examiner* — Nathaniel Lee
(74) *Attorney, Agent, or Firm* — Bacon & Thomas, PLLC

(57) ABSTRACT

An LED light device has at least one electric coil and at least one corresponding magnetic element built-in on a movable pendant to cause at least one part to have a moving, waving, or shaking function. The pendant can be arranged to move a lens and project a moving, waving, shaking, or vibrating LED light image on a non-moving surface or to cause moving, waving, or shaking of one or more parts of the body of the device.

19 Claims, 14 Drawing Sheets

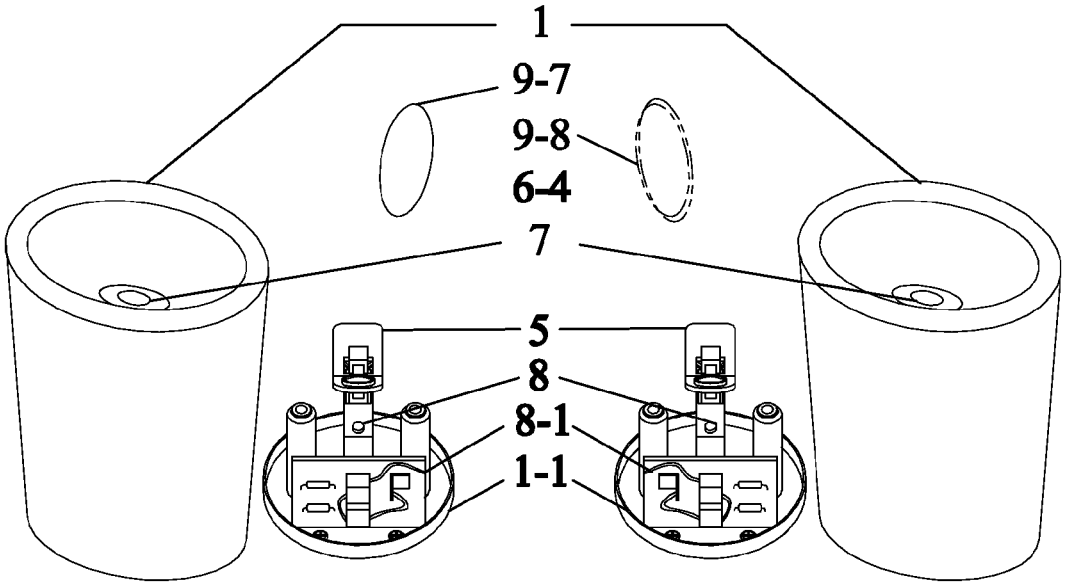
Fig 5A
Fig 5B
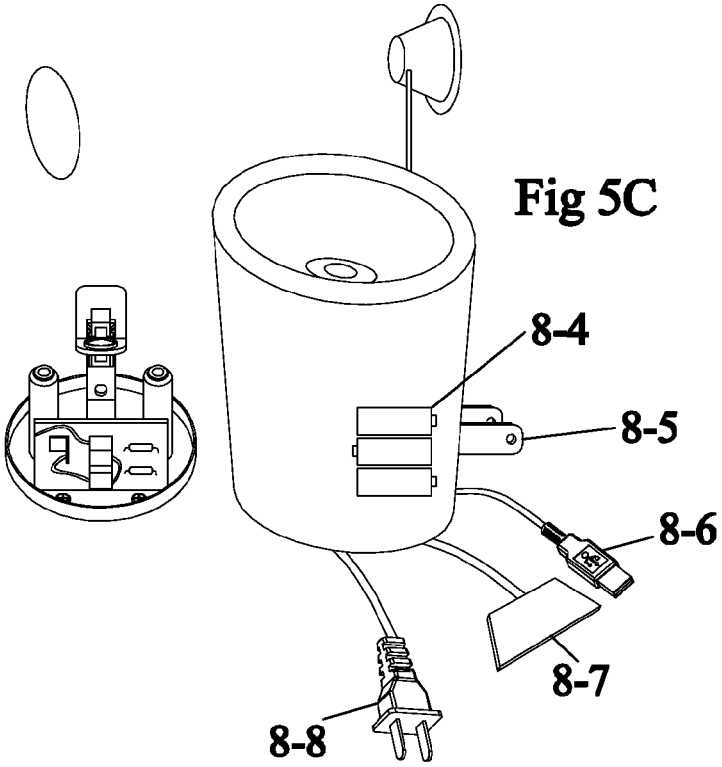
Fig 5C

LED LIGHT HAS ELECTRIC COIL-MEANS AND MAGNETIC-MEANS

BACKGROUND OF THE INVENTION

U.S. Pat. No. 8,070,319 discloses a pendulum including a moving display paper or plastic piece illuminated by an LED light beam. The moving pendulum lacks a built-in optics lens. In contrast, the current invention includes an optics-lens built into a moving body. A fixed LED light beam passing through the moving optics-lens is varied because the LED light beam is input to different positions of the optics-lens, causing changes in the light input angle and intensity, optics-lens cross-section, and optics-lens thickness encountered by the light beams from the LED, so that a resulting image of the LED light source will change in a very nice and natural manner like a candle in the wind.

Requiring the LED light beams to hit a moving paper or plastic piece in the absence of an optics-lens, as disclosed in U.S. Pat. No. 8,070,319 is like using a gun to shoot a moving target. in that the LED light beams can only hit the target or fall outside the moving target There is no variation in the light beams that do hit the target and thus the light effects look very bad and it is difficult to show the image on a non-movable surface that is big and wide.

The current invention has subject matter in common with projection devices disclosed in the inventor's U.S. patent application Ser. No. 12/938,564 (laser projector); Ser. No. 12/948,953 (time projector); Ser. No. 13/021,107 (3D projection); Ser. No. 13/549,728 (LED bulb projection); Ser. No. 14/024,229 (LED kaleidoscope); Ser. No. 14/023,889 (multiple reflectors projection); Ser. No. 14/019,779 (water projection); Ser. No. 14/030,023 (motor projection without liquid); Ser. No. 14/030,023 (LED light having motor means and projection image): Ser. No. 14/019,779 (multiple function LED projection light having built-in motor means); Ser. No. 14/024,229 (LED light has kaleidoscope means to project image); and Ser. No. 13/021,124 (LED light has changeable image and pattern by kaleidoscope means to project to surfaces).

The inventor's U.S. patent application Ser. No. 12/710,918, now U.S. Pat. No. 8,277,918, discloses an LED light having more than one reflector means, which is similar to an embodiment of the current invention in that the LED light includes more than one reflective means assembled to a kaleidoscope means. The inventor's U.S. patent application Ser. No. 11/806,284, now U.S. Pat. No. 7,632,004, discloses an LED light having more than one optic means, which is similar to an embodiment of the current invention in that applies optics means in front of or in back of the light means to create, adjust, magnify, reduce, or enlarge an image, the optics means including any combination of an optics lens, optics mirror, laser hologram, laser grating film, or optics assembly.

The inventor's U.S. Pat. No. 7,455,444 discloses an LED light having more than one LED light source. An embodiment of the current invention uses more than one LED in a matrix arrangement that can be turned on and turned off to create desired light patterns.

Other prior U.S. patent applications of the inventor that disclose subject matter in common with the present invention include U.S. patent application Ser. Nos. 12/914,584, 12/318,471, 12/318,470, and 12/834,435.

Still further, additional projection devices are also disclosed in the inventor's U.S. patent application Ser. No. 12/292,153 (now U.S. Pat. No. 7,871,192), U.S. Ser. No. 12/232,505 (now U.S. Pat. No. 7,832,917), U.S. Ser. No. 12/318,473 (now U.S. Pat. No. 7,832,918), Ser. No. 12/624,621 (now U.S. Pat. No. 8,303,150), Ser. No. 12/771,003 (now U.S. Pat. No. 8,408,736), Ser. No. 12/876,507 (now U.S. Pat. No. 8,083,377), Ser. Nos. 12/886,832, 12/938,564, 12/948,953, and 13/021,107.

The inventor also has filed patent applications that disclose light devices having interchangeable AC and DC power sources, including for connection to or including any combination of prong means, extension cords, adaptors, transformers, solar or wind power sources, batteries, chemical power, and biological power that can be interchanged for use in desk top and plug-in type projection light devices having built-in kaleidoscope means. The interchangeable power source applications of the inventor include U.S. patent application Ser. Nos. 12/318,473 and 12/940,255 (now U.S. Pat. No. 8,231,246).

Finally, the following is a list of the inventor's patent applications (including some that are also listed above), that disclose the following included or optional features of the present invention: (1) a project light device, (2) more than one optics means, (3) more than one LED, (4) more than one reflective means, (5) interchangeable power sources, (6) laser means, (7) adjustable focus and position changing, and (8) a motor and gear set: U.S. patent application Ser. No. 12/710,561 ("LED power failure Light"); Ser. No. 12/711,456 ("LED light device has special effects"); Ser. No. 12/771,003 ("LED light device has more than 1 reflective means for plurality of image"); Ser. No. 12/624,621 ("projection device or assembly for variety of LED light"); Ser. No. 12/622,000 ("Interchangeable Universal Kits for all LED light"); Ser. No. 12/318,471 ("LED night light with pinhole imaging"); Ser. No. 12/318,470 ("LED night light with Projection features"); Ser. No. 12/318,473 ("LED night light with laser or hologram element"); Ser. No. 12/292,153 ("LED night light with Projection or imaging features"); Ser. No. 12/232,505 ("LED night light with Projection features"); Ser. No. 12/149,963 ("Removable LED light device"); Ser. No. 12/149,964 ("Surface Mounted Device with LED light"); Ser. No. 12/073,095 ("LED Track light device"); Ser. No. 12/073,889 ("LED light with changeable position with Preferable power source"); Ser. No. 12/007,076 ("LED light with changeable geometric system"); Ser. No. 12/003,691 ("LED light with changeable geometric dimension features"); Ser. No. 12/003,809 ("LED light with changeable features"); Ser. No. 11/806,711 ("Multiple LED light with adjustable angle features"); Ser. No. 11/806,285 ("LED Night light with outlet device"); Ser. No. 11/806,284 ("LED Night light with more than 1 optics means"); Ser. No. 11/527,628 ("Multiple function Night light with air freshener"); Ser. No. 11/527,629 ("LED Night light with interchangeable display unit"); Ser. No. 11/498,874 ("Area illumination Night light"); Ser. No. 11/527,631 ("LED Time piece night light"); Ser. No. 12/545,992 ("LED time piece Night light"); Ser. No. 12/292,580 ("LED Time Piece Night light"); Ser. No. 11/498,881 ("Poly Night light"); Ser. No. 11/255,981 ("Multiple light source Night Light"); Ser. No. 11/184,771 ("Light Device with EL elements"); Ser. No. 11/152,063 ("Outlet adaptor with EL"); Ser. No. 11/094,215 ("LED night light with liquid medium"); Ser. No. 11/094,215 ("LED Night light with Liquid optics medium"); Ser. No. 11/092,741 ("Night light with fiber optics"); Ser. No. 10/883,747 ("Fiber Optic light kits for footwear"); Ser. No. 11/498,874 ("Area Illumination for LED night light"); Ser. No. 11/527,629 ("Time Piece with LED night light"); Ser. No. 11/527,628 ("Multiple Function Night light with Air Freshener"); Ser. No. 11/806,284 ("LED Night light with more than one optics mediums"); Ser. No. 11/806,285

("LED Night Light with multiple function"); and Ser. No. 11/806,711 ("Multiple LEDs Light with adjustable angle function").

The applications of the inventor in general all apply physics or optics theory to LED light supplied with power from an outlet, battery, solar, or other power source. The present invention uses physics or optics theory to create moving, waving, shaking, or vibrating images on a non-moving surface or a moving, shaking, waving, or vibrating LED light body or housing or parts. To accomplish this, the current invention may uses at least one optics means, and LED light means incorporated with an electric coil means and magnetic means to transform an LED spot light into moving flame images or otherwise cause the LED light body or housing or parts to generate effects that can be seen by a viewer. The principles of the invention may be applied to any kind of LED light, including LED lights disclosed in the above-listed patents and patent applications of the inventor, which may be powered by a variety of power sources, such as an outlet, batteries, solar, wind, or chemical power sources.

Further cost saving can be achieved in the case of a battery powered unit by using a circuit with proper electric components, parts, and accessories to raise the voltage output of the batteries to trigger the LED or LEDs even though the number of batteries is less than that normally required to generate the required voltage. This can counter the tendency of people to use a large quantity of batteries and save substantial cost, which is another important advantage of the current invention.

In another embodiment, a plurality of the LED beams can be projected through non-moving surfaces, while still exhibiting motion effects.

The LED or LEDs of the current invention are preferably connected with circuit means, power means, contact means, electric coil-means, magnetic means, conductive means, switch means, sensor means, motor means, spin means, rotating means, gear set means, speed control means, printed circuit means, blue tooth means, remote control means, infrared means, Internet means, WiFi means, integrated circuit (I.C.) means and/or related parts and accessories to cause the LED or LEDs to turn on and off according to a predetermined time period, functions, colors, and/or effects to provide a desired lighting performance.

The LED or LEDs can be selected from any combination of single color, multiple color, multiple piece, standard, and special LED assemblies, with the number of LEDs ranging from 1 to N (N can be any number). If multiple LEDs are included, at least some of them can be arranged in a desired matrix pattern.

The distance, position, and orientation of the optics means and/or the LED or LEDs can be selected to create any desired moving light patterns, or the moving light patterns can be created by a moving housing, moving body, moving parts, color changing, image changing, or other moving effects that can be seen on surrounding non-moving surfaces including walls, a ceiling, a floor, or any other desired surface. In addition, the optics means can have any shape with multiple constructions, and may include any combination light-transmitting, reflective, convex, concave, laser, and hologram lenses on either an inner or outer side surface, or all surfaces, to make certain light effects.

According to another preferred embodiment of the invention, an LED light device having power saving features may include at least one LED or LEDs for a light source, at least one housing having space to install circuit means, conductive means, electric components parts and accessories, switch means, sensor means, an integrated circuit (IC), and/or a micro controller to connect with a conventional market-available power source to cause the LED or LEDs to turn on and turn to provide predetermined functions or effects, with a predetermined duty cycle, color, and/or brightness. In this embodiment, the power-saving features are obtained by using the control means to cause the LED or LEDs turn-on for only a certain percentage of each cycle. In particular, the turn on time is selected to meet the persistence of vision of the human eye, so as to take advantage of the human eye's response time of 1/24 to 1/16 second so that the blinking LED or LEDs looks as if it were continuously on.

According to yet another embodiment of the invention, an LED light device having cost saving features may include at least one LED or LEDs as a light source, at least one housing having space to install circuit means, conductive means, electric components parts and accessories, switch means, sensor means, an integrated circuit (IC), and/or a micro controller to connect with a conventional market-available power source, preferably batteries, to cause the LED or LEDs to turn on and turn off according to a predetermined function or effects, duty cycle, color, and/or brightness. In this embodiment, cost saving is obtained by providing batteries having a total voltage that is less than the LED trigger voltage and by providing electric components and related parts and accessories to increase the voltage output of the batteries to greater than the LED trigger voltage.

The current invention may also use an electric coil-and-magnet cause a plurality of LED light beams to pass through moving optics means and thereby create motion effects. The relative distance, position, and/or orientation of the electric coil and at least one of related magnet can be selected to optimize the moving, waving, shaking, or vibration of a pendant or moving body to which the optics means or a display unit is attached.

BRIEF DESCRIPTION OF THE DRAWINGS

As shown in FIG. 1A, additional LEDs can be positioned inside the housing so that the whole body glows.

FIGS. 5A-5C show the construction and operation of the light device of the first preferred embodiment from a different angle, with FIGS. 5A and 5B showing changes in the projected image from the original image to the changed image. FIG. 5C shows some of the different types of power inputs that may be utilized, including an AC plug, a solar panel, a USB plug, prongs for direct insertion into an AC outlet such as a wall outlet, and batteries.

DETAILED DESCRIPTION OF THE PREFERRED EMBODIMENTS

Figure 1:
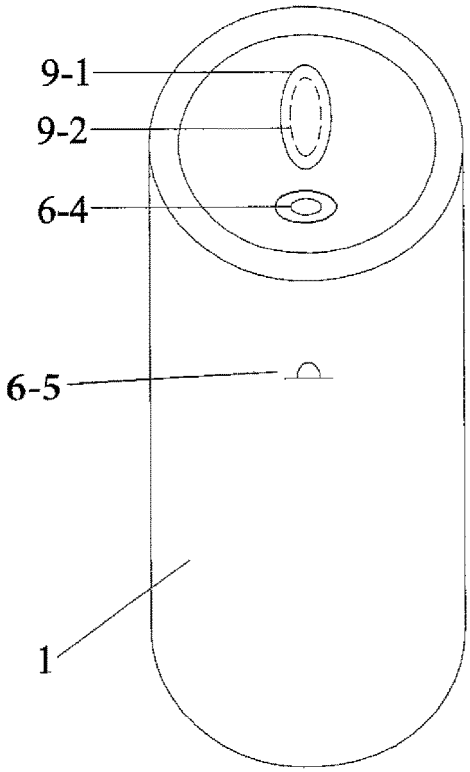
FIGS. 1 and 1A show a first preferred embodiment of the current invention that includes a coil-means and magnetic means (illustrated in detail in FIGS. 2A, 2B, and 7) that interact to cause a pendant to move and thereby also cause a built-in optics lens to move. Movement of the pendant and lens (also illustrated in detail in FIGS. 2A, 2B, and 7) causes light beams passing through the moving optics-lens from an LED to project a moving flame-like image through an opening to a non-movable surface (illustrated for example in FIGS. 3 and 3A-3C) on a housing of the light device, the image varying from big to small so as to provide a flickering flame effect. The light device of FIG. 1 may be powered by an interchangeable power source, USB wire or other power source. The illustrated first preferred embodiment of the current invention, which forms an LED candle or LED candle set, preferably uses a DC or USB power-means or an interchangeable power source, but it can also use prong means to work with an AC power source.

An LED light device includes at least one LED arranged as a light source to supply visible light beams, at least one electric coil-means which will create a magnetic-field when an electric current passes through the coil's conductive wire, and at least one magnetic-means that may include a magnet(s), electric coil(s), or magnetically-activated means. The LED light device may also include one or more of a pendant-means, a frame(s), arms, supports, connector(s), a joint-piece(s), a holder(s), cam axis means, substrate means, mechanical pieces, an optics lens, a convex or concave lens, a lens assembly, a telescope means, a film, a display-unit, a transparent material, a translucent material, laser created means, lenticular means, grating film, hologram means, Lcos means, digital data means, screen-means, display-means, a textured piece, an injection plastic piece, a projection means, device, or assembly, an image magnifying lens or means, image creating means, a tube, a light transmitting means, a light blocking out means, optics pieces, diffusion pieces, and an electric circuit that may include conductive means, wires, a light source, circuit means, IC means, timer means, sensor means, Bluetooth means, switch means, second or more LED light means for other light functions, remote means, control means, speed control means, and printed circuit means to cause apparent or actual movement, waving, or shaking of a light image.

The said LED light source not only can offer area illumination functions but also can have additional functions selected from a night light, projection light, accent light, glowing character light, display light, glow parts and accessories, countdown night light, motion sensor light, Blue tooth light, remote control light, WiFi light device, Internet light device, power fail light, garden light, moving image light, and any other light, with power supplied by any one or more of a prong means, power means, solar power, batteries, adaptor means, receptacle means, energy storage means, transformer, invertor, AC power source, DC power source, AC and DC or interchangeable power means, and which may further include power or cost saving means, angle adjust means, rotating means, focus adjustable means, motor means, gear set means, or other means to provide a perfect LED light device for plug-in, desk top, or window hanging applications for indoor and outdoor use.

The said LED light device may incorporated with other devices such as a speaker, audit device, video device, camera device, recorder device, speaker, sensor means, switch means, remote control device, Bluetooth device, power device, USB charger device, AC outlets power device, digital data storage device, memory card device, memory storage device, energy storage device, receiving device, sound device, water lighting device (water dance, water wave), light show device, and communication device to provide additional functions to the moving, shaking, vibrating, and shape-varying image effects provided by the magnet and coil means. The LED light device may also serve as a desk lamp, night light, USB light, garden light, patio light, table light, accent light, power fail light, remote control light, security light, doorbell light, character light, plant light, solar light, flashlight, candle light, commercial light, advertisement light, promotion light, or window hang-on light device, or any other LED light device.

According to a first preferred embodiment, the LED light device may be an LED candle light having at least one LED to create a moving flame image on any non-movable surface including the candle light body or a wall, ceiling, or any other surface, with additional LEDs being optionally provided to cause the candle body or housing to glow and thereby provide a night light or accent light with designed performance.

The said LED candle light may have its own circuit means, switch means, sensor means, timer means, remote control means, Bluetooth means, infrared means, control means, CDS means, or IC means to control the LED light source and/or electric coil-means to deliver and not-deliver electric current with a predetermined timing, color(s), brightness, performance, functions, or effects.

Figure 1A:
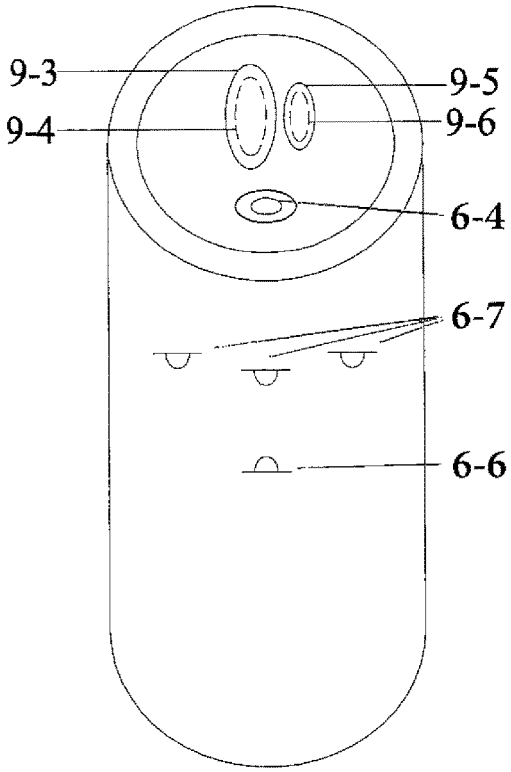

FIGS. 1 and 1A show an LED light device (1) having a moving, waving, swinging, shaking, or vibrating LED light source image with a flame appearance, indicated by reference numeral (9-1), (9-2), (9-3), and (9-4). The flame image is projected from an interior LED light source (6-5) or (6-6) through the opening (6-4) and a moving optic-lens installed on a moving pendant (shown in FIGS. 2A and 2B, which causes the flame image to move like a candle in the wind and therefore look real but without any-danger for people to install on a window, desk top, or plug-in wall outlet. The moving optics-lens is installed on the moving pendant so that light beams will pass into the optics lens from different input angles, which causes the flame image to become bigger (9-1) and smaller (9-2), and the location and orientation to also be different. Whether the flame image projects on a non-movable surface of the device itself or on a wall or ceiling, depend on the relative positions of the LED light source position and optics-lens, as well as the position of the opening, cut-out, or window through which the image is projected.

FIG. 1A show a variation of the first preferred embodiment in which the LED light device has more than one LED light source, including projection light source (6-6) and additional light sources (6-7) which can make at least part of the device body or housing be illuminated and thereby make the whole piece look better in a dark environment. This application is better to apply to kids' and child products including toy items, character items, game items, decorative items, gift items, give-away items, commercial items, advertisement items, promotional items, slogans, signs, art-related items, or consumer electric products, computer products, communication products or other products available from the marketplace. The moving, waving, shaking, and vibration features will cause a character, toy, display unit, or commercial sign to more easily catch people's eyes and bring attention to the LED light.

Figure 2:
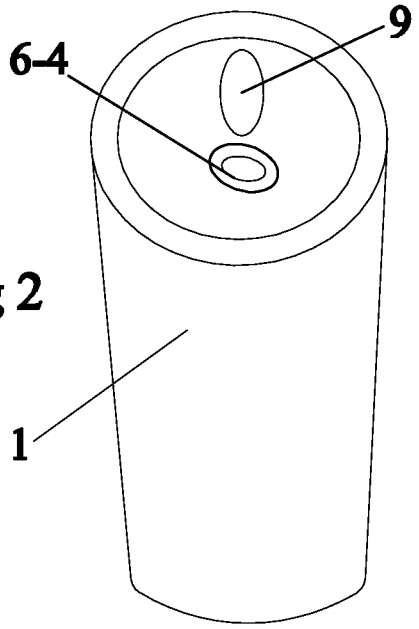
FIGS. 2, 2A, and 2B show details of the first preferred embodiment of the current invention, which can for example be plugged into a desk top, or hung in a window application and which has an electric coil-means and related magnetic means to cause at least one LED to emit light beams through a moving optic-means and project the light beams to a non-movable surface of the housing or body of the LED light. In addition, additional LEDs may be provided to cause the LED light housing to glow and the light device may have added functions because there is plenty of space under the LEDs to add an electric device, digital device, communication device, computer device, consumer device, or other function-adding device.
Figure 2A:
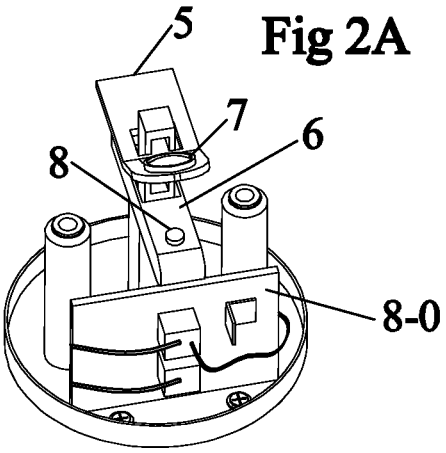
Figure 2B:
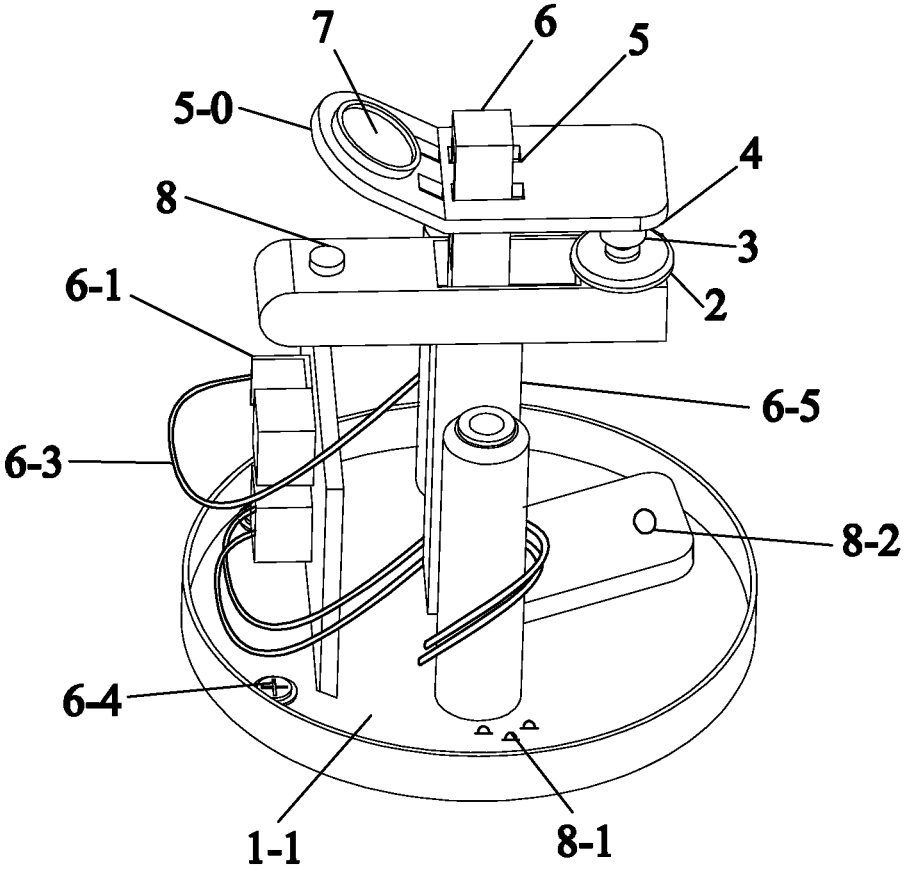
Figure 3:
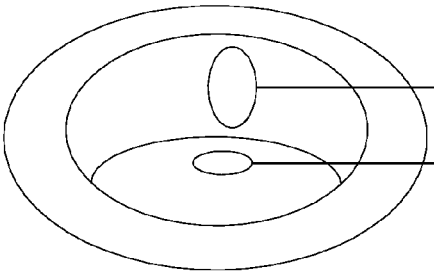
FIGS. 3 and 3A-3C illustrated how different light images may be projected through the opening onto a non-movable surface by the moving pendant 5 of FIGS. 2A and 2B so as to cause changes in the projected image by varying the position, orientation, angle, and/or cross section of the optics-lens 7 encountered by the light beams so that the resulting image changes size, position, orientation, and brightness to cause candle-in-the-wind effects.
Figure 3A:
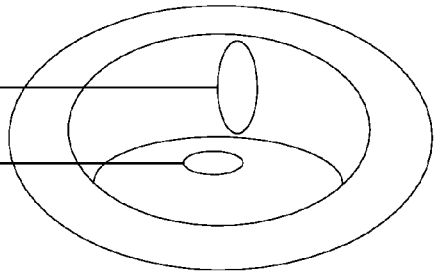
Figure 3B:
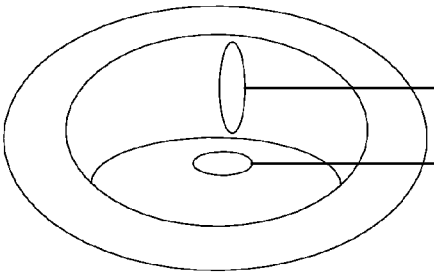
Figure 3C:
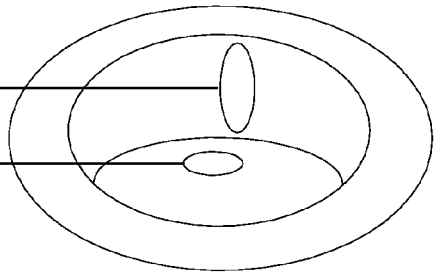
Figure 4A:
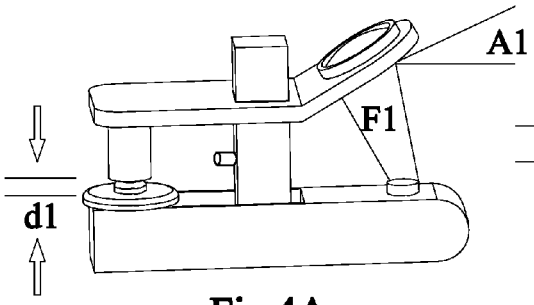
FIGS. 4A-4D show the manner in which the inner electric coil-means and related magnetic means interact to cause the pendant to move to different positions when the input current to the electric coil-means changes, thereby causing the optics-lens to change position and the image projected by the optics-lens to change, move, wave, swing, vibrate, and so forth.
Figure 4B:
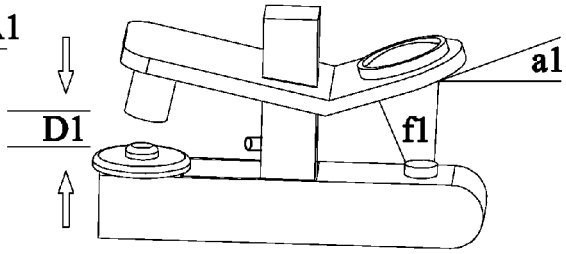
Figure 4C:
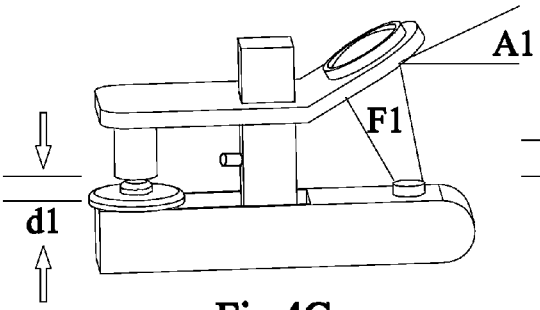
Figure 4D:
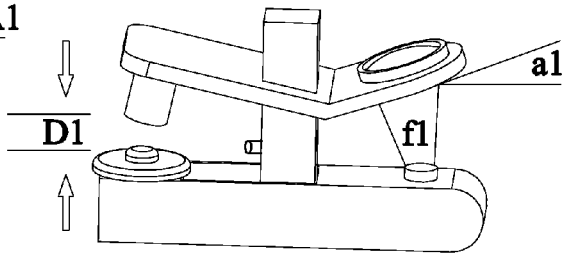

FIGS. 2, 2A, and 2B show the LED light device body (1) having opening (6-4) to allow inner LED light source to project flame like image (9) on a non-movable surface which is the body of the LED light device (1). the image can alternatively also be projected to a surrounding wall, ceiling, or background by making some adjustments to the opening (6-4), and the inner LED light source (not shown in FIG. 2), the inner moving pendant, and the built-in optics-means. Additional LED light device features disclosed for example in the inventor's other patents and patent applications may also be included in the LED light device of FIGS. 2, 2A, and 2B, and other drawing figures.

The housing or body (1) shown in FIG. 2 can also be made to glow by adding LED light sources, which may be installed on the top of the inner surface of the housing or body (1) so that the light beams will spread out and not show inner part's shadows. Alternatively, the inner surface body may be provided with a diffusion optics treatment to cause the light diffuse or spread out through the body to get a very good photometric arrangement.

A seal-means can be used to seal the high brightness spot of the LED light source within the seal-means so that the light comes out very evenly on any point or sides. Any such equivalent or alternative methods of obtaining an even or glowing light effect will still fall within the scope of the current invention.

FIGS. 2A and 2B show details of a preferred construction of the electric coil-means and related at least one magnetic-means and moving pendant of the first preferred embodiment illustrated in FIGS. 1A, 1B, and 2. The said movable pendant (5) has a built-in optic-lens (7) and magnetic-means (3) install on the end of the pendant (5) so that it can magnetically interact with the electric coil-means (2) to cause movement of the pendant (5) the electric current amount in the electric coil-means (2) is changed, the optic-lens (7) and magnetic-means (3) being installed at a desired location inside of the LED light device housing. The LED light source (8) is installed on the inside of housing and has a proper distance, location, and orientation relative to the optics-means (7) installed on the moving pendant (5). When the pendant magnetic-means interacts with the electric coil-means' magnetic-field force, then the pendant (5) will move, and so will the optic-lens (7) to cause light beams from the LED light source (8) to pass through the optics-lens (7) at different angles of incidence and locations before passing through the housing opening (6-4) or cut-out or windows to be seen by a viewer.

Additional details of the light device of FIGS. 1, 1A, and 2, as shown in FIG. 2A, include the provision of a base (1-1) for mounting LEDs (8-1) that illuminate the housing (1), an optional screw or other fastener for securing the base to another object or surface, and wires (6-3) for supplying electricity to the LED (8) and coil (2) of the coil means. The pendant (5) is pivotally mounted on a frame (6) extending from the base (1-1), and includes a holder (4) at a distal end opposite the lens (7). The holder (4) holds the magnet (3) of the magnetic means, which is positioned to interact with the coil (2) when the coil (2) is energized, thereby causing the pendant (5) to pivot and move the lens (7) relative to the LED (8), thereby causing the flickering effect illustrated in FIGS. 1 and 1A. A quick connector (6-1) and circuitry for controlling the LED (8) and energization of the coil (2) are provided on a circuit board that includes a variety of parts and accessories (8-0).

FIG. 2B also shows pendant related parts including holder (4), frame (6), connector means (6-1), arms, supports, connector(s), joint-piece(s), holder(s), cam axis means, substrate means, mechanical pieces and electric current delivery means as well as LED (8), circuitry with all related parts and accessories (8-0), the more than one LED (8-1) for illuminating the housing or body, a switch or sensor or control means (8-3) to cause the LED or LEDs to turn on and turn off with desired functions, performance, and effects. The circuit means or circuitry may include all parts and accessories to provide the at least on LED with desired light functions, including electric components related to a power fail detector, timer, countdown timer, motion sensor, Bluetooth operation, wireless control, remote control, infrared control, smoke detector, flood detector, built-in whistle means, and other added electric functions available from the marketplace.

FIGS. 3 and 3A-3C show the manner in which the flame image of the first preferred embodiment projects through the opening (6-4) in the LED candle body to create a moving flame image having different sizes, brightness, position, color, orientation, and angle. The flame image projects to the device non-movable body, but can also project to other surfaces as discussed above.

FIGS. 4A-4D show the relation of the:

(1) LED light source (8) to optic-lens (7) marked by f1, f2, F1, F2;

(2) moving pending (5) to the electric coil-means (2) and magnetic-means (3) indicated by d1, d2, D1, D2; and (3) the moving pendant (5) to a horizontal line marked by a1, a2, A1, A2.

The relation that allows the LED light source (8) to emit light beams into the moving pendent (5) depends on distances f1, f2, F1, F2 between the LED light source (8) and the optics-lens (7) and angles a1, a2, A1, A2 between the optics-lens (7) and a horizontal line as the optic-lens moves closer to or away from the said LED light source (8), and also on the changing distances d1, d2, D1, D2 between the magnetic means on the pendant (5) and the electric coil means as the amount of current in the coil means is varied. The changing positions of the pendant (5) and optic-lens (7) as a result of interaction between the magnetic means (3) and electric coil-means (2) causes the image created by the LED light beam input to optics-lens (7) to also vary in size, position, brightness, orientation, color, etc. when projected onto a non-movable surface.

FIGS. 5A and 5B show different LED flame-like light images (9-7) and (9-8) generated by the light device of the first preferred embodiment and that can vary in size, position, orientation, color, and brightness. FIG. 5C shows the different conductive means to connect with different power sources, including an AC plug (8-8), solar panel (8-7), USB connector (8-6), and prongs (8-5) for insertion into a wall outlet. Alternatively, the light device may be powered by batteries (8-4).

Figure 6A:
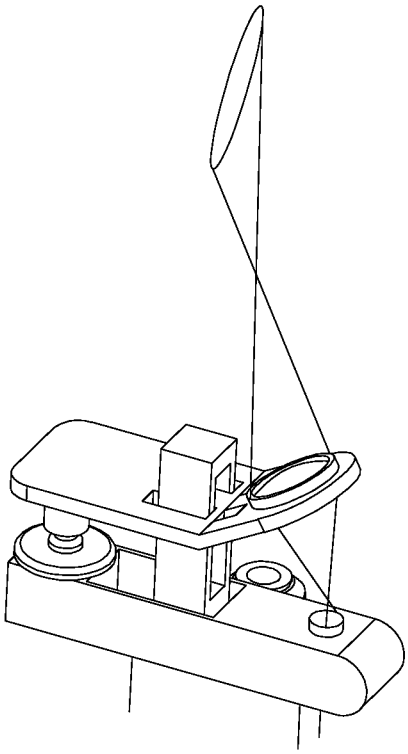
FIGS. 6A and 6B show details of the manner in which an image passing through the moving optics lens can change size and shape in response to movement of the pendant means into which the optics lens is built. The changes in the projected image not only can include changes in size and position, but also color, orientation, etc.
Figure 6B:
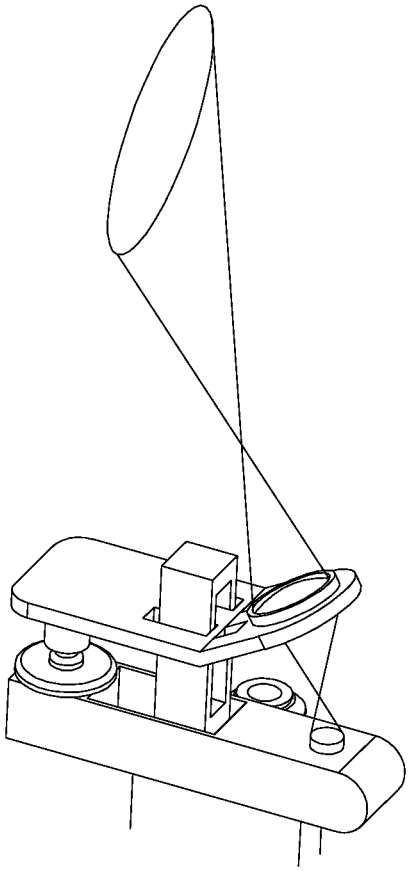
Figure 7:
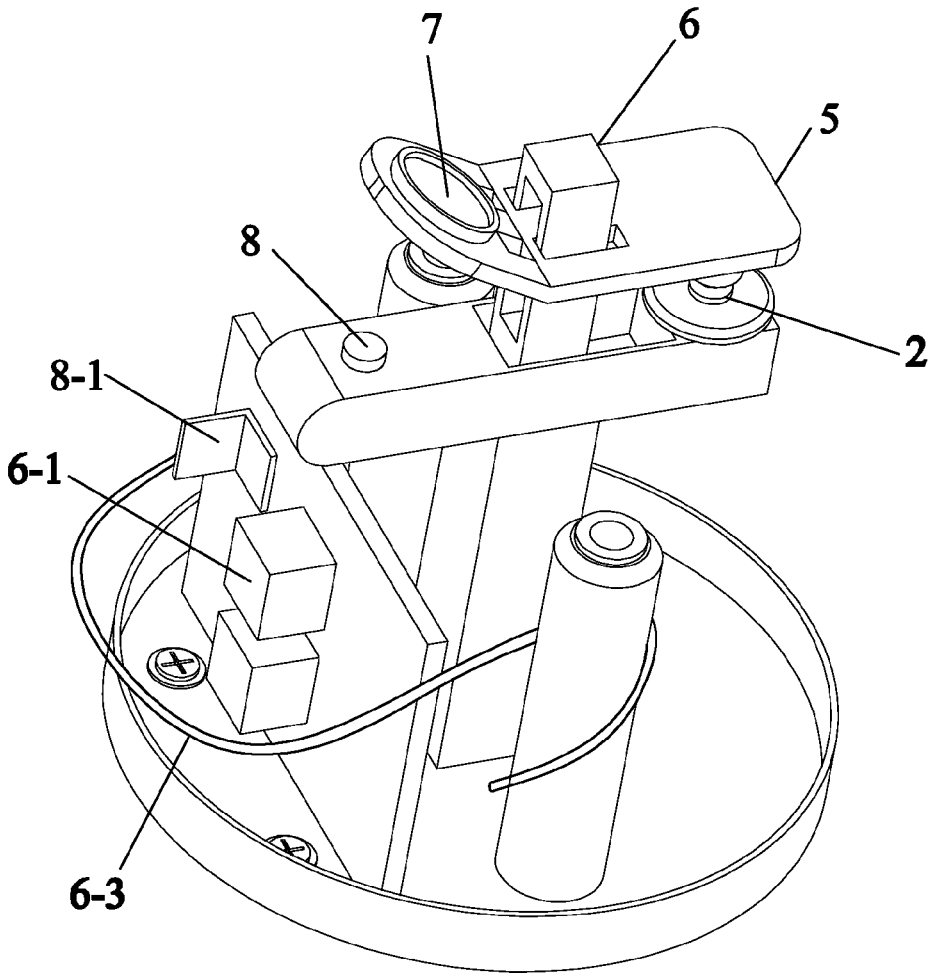
FIG. 7, 8A to 8C show the same components of the first preferred embodiment as shown in FIGS. 2A and 2B, but from different angles.

FIGS. 6A and 6B illustrate the physics theory that explains how to project image (9) through at least one of the optics-means (7) built-in to the said moving pendant (5). This preferred embodiment uses a convex lens so an LED light beam passing through the lens surface and the lens thickness undergo changes depending on the angle and location of incidence. The reason why the image in this example is projected onto a wall and not onto the ceiling is that the LED light source (8) and optics-lens are at an angle. The angle can be adjusted as needed to make image project to another surface The optical principles involved are further explained in the inventor's U.S. patent application Ser. No. 13/549,728.

Figure 8A:
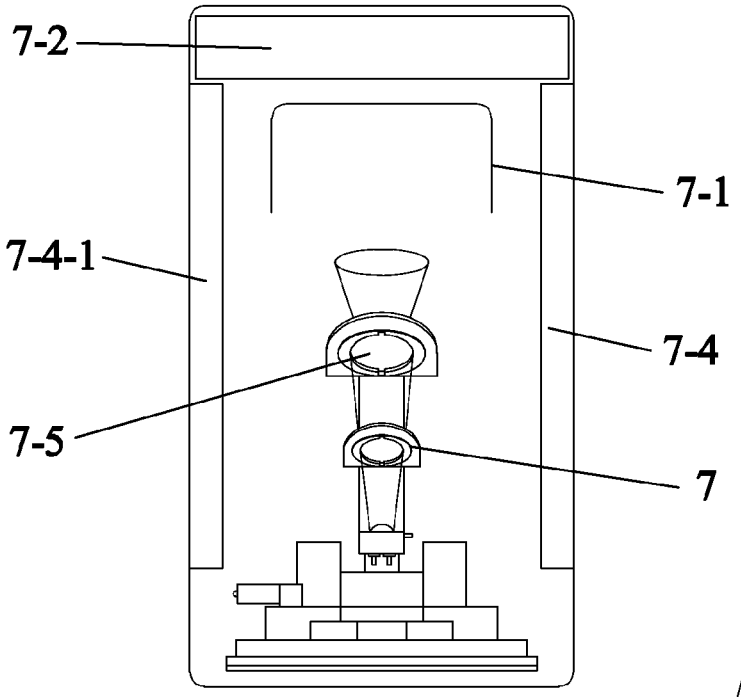
Figure 8B:
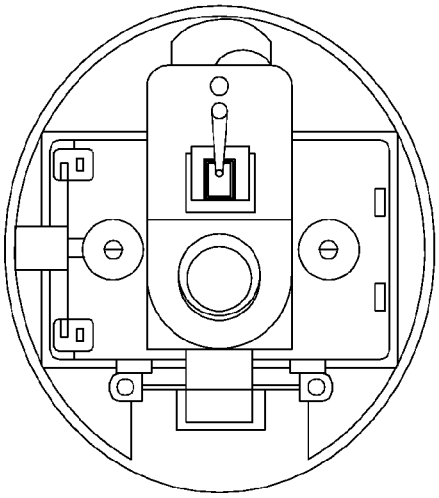
Figure 8C:
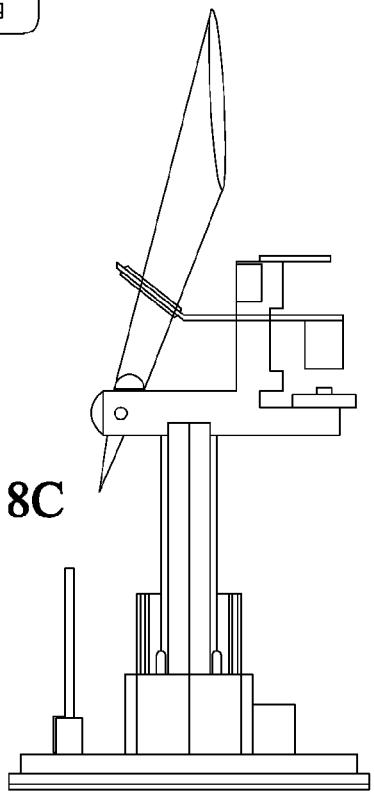

FIGS. 7A and 8A-8C show further details of the construction of the first preferred embodiments, including the elements discussed above in connection with FIGS. 2A to 2C as well as optional added features shown in FIGS. 8A to 8C, such as additional optics means (7-5) for providing further light effects, light blocking means (7-4) with an opening (7-4-1) to enable passage of the image without shadows cast by inner parts, a second optional optics means (7-1) with desired designs or stenciling, and a third optional optics means with texture, art work, or geometric markings to enhance the appearance of the projected image.

Figures 9A, 9B, 9C:
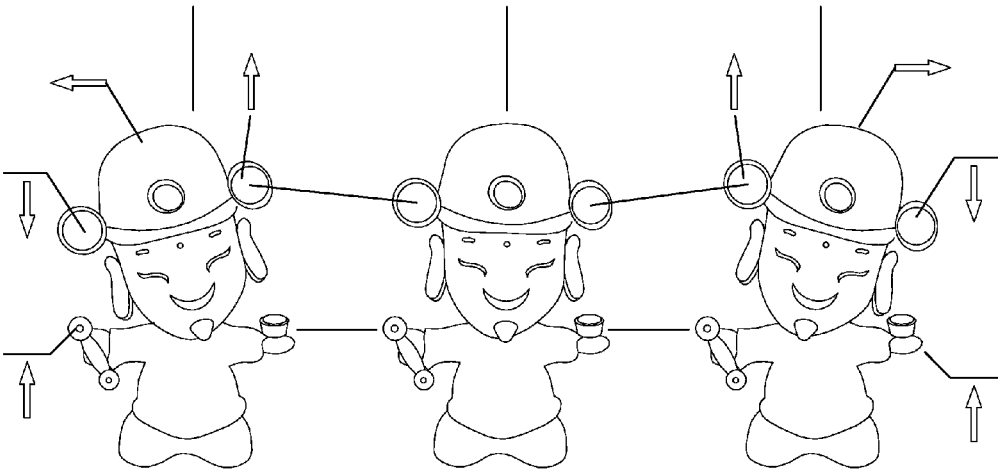
FIGS. 9A-9C show a second preferred embodiment having a moving, waving, shaking, or vibrating LED light device in the form of a character product which is lighted by at least one inner LED light means and has a built-in electric coil-means and magnetic means that interact to cause a pendant and related arms, frame, post, joint-means, adjacent piece, plastic piece, rod, support and related parts and accessories to move together and thereby cause at least parts or the whole character product or LED light to move when an input current to the electric coil-means is changed. The LED light device or character product may have any geometric shape including shapes that are conventionally non-movable. The light device or character product can be a toy item, character item, game item, decorative item, gift item, give-away item, commercial item, advertisement item, promotional item, slogan, sign, infant related item, child item, consumer electric product, computer products, communication product or any other type of product available from the marketplace that can have a built-in electric coil-means and at least one magnetic means with at least one LED light means to project light or illuminate the product's body, housing, or parts.

FIGS. 9A-9C show a second preferred embodiment which has a cosmetic or display-unit added on to the inner moving pendant and its related arms, supports, frames, joint means, connection means, crank means, sharp tip means, and screw means (6-1) (6-2) (6-3) (6-4) (6-5) to cause parts of the display-unit, illustrated here as the head and arms of a character, to move, wave, shake, and/or vibrate based on the interaction between the electric coil-means (2) and magnetic-means (3). Further, the whole body of the character display-unit can be made to glow by including more than one LED light means (8-1). From FIG. 9A, one can see that the display-unit has a head at the center and two arms extending horizontally. A switch is provided to prevent the pendant from moving. When the movement preventing means is released, the electric coil-means and magnetic means interact with each other, causing the display unit to carry out head shaking and arm waving to for eye-catching effects. When an optional LED light is provided to project an image or cause the at least part of the device to glow, the movement can be seen by people during night time or even in a dark environment. Furthermore, a 30 minute countdown timer can be added to shut off the glow light after using a switch to turn it on, and/or music, sound, or melody can be added to help kids to fall asleep. Still further, an alarm clock function can be added to let the device have more functions and become a high value product. Thus, the current invention can be modified add additional functions including any functions that appeal to a person's eyes, nose, mouth, ear, body, or skin and that can be seen, heard, smelled, eaten, felt, or touched, in addition to the above-described functions of (1) a movable device having built-in electric coil-means and magnetic-means, and (2) at least one of LED light source to project a moving image or to cause at least a part of the body or housing to glow.

Figure 9D:
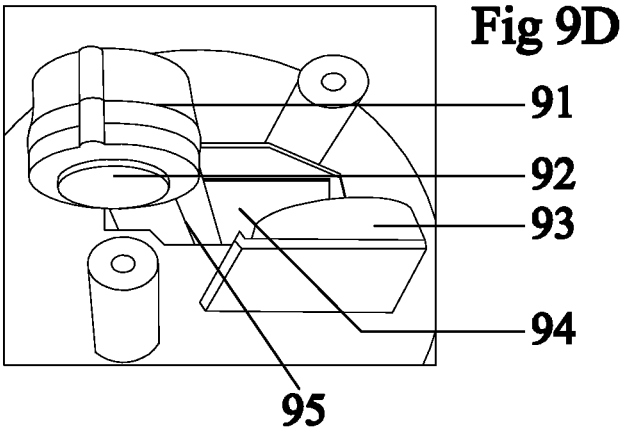
FIGS. 9D-9F show details of the moving pendant, electric coil-means, and at least one magnetic-means.
Figure 9E:
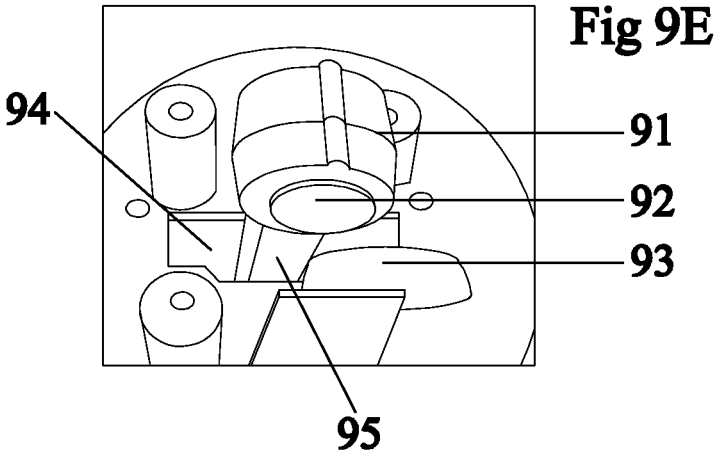
Figure 9F:
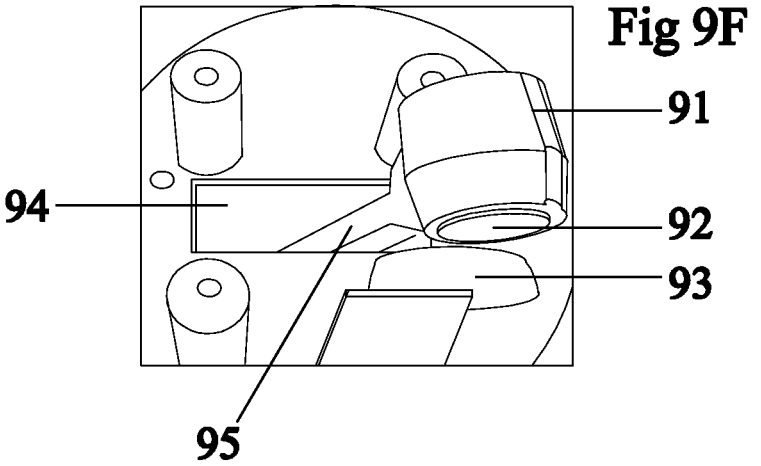

FIGS. 9D-9F show the relation between the electric coil-means and magnetic-means for the second preferred embodiment, which are the same as the electric coil means and magnetic means described above in connection with FIGS. 4A-4D and therefore no described in detail here.

Figure 10A:
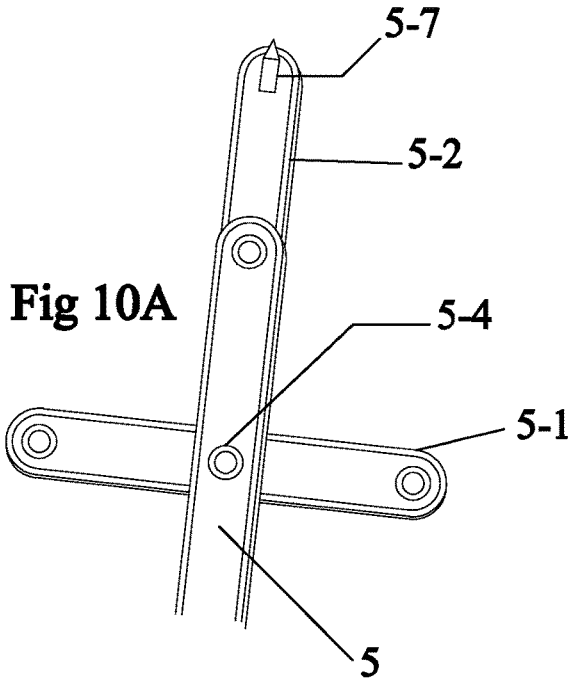
FIGS. 10A-10C a mechanism for causing multiple parts of the product of FIGS. 9A to 9F to move together with the moving pendant in response to interaction between the at least one magnetic-means and the electric coil-means. The moving mechanism includes a sharp tip with the least contact area with the moving display unit to provide a more sensitive and smooth motion. If the contact area is too big, it will cause a large resistance by friction between the contact-surfaces. The mechanism also has a plurality of joint-means in a variety of forms to enable the separate or district pieces to work together.
Figure 10B:
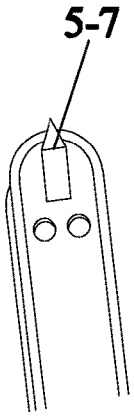
Figure 10C:
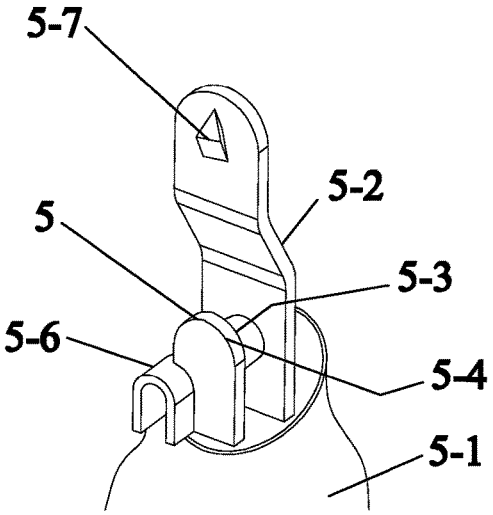

FIGS. 10A-10C show a moving pendant (5) and its frame (6-1), a support (5-2), arms, bars, an extension piece, joint-means (5-3), joint head means (5-6), connect means, fastening means, an extension frame, a tip for causing the two arms (5-4) to wave, and a tip for causing the head (5-7) to wave in response to movement of the pendant (5) due to the magnetic force between the electric coil-means and corresponding magnetic-means. By providing sharp tips (5-7) (5-4) to cause the arms and head to wave, friction is minimized.

Figures 11A, 11B:
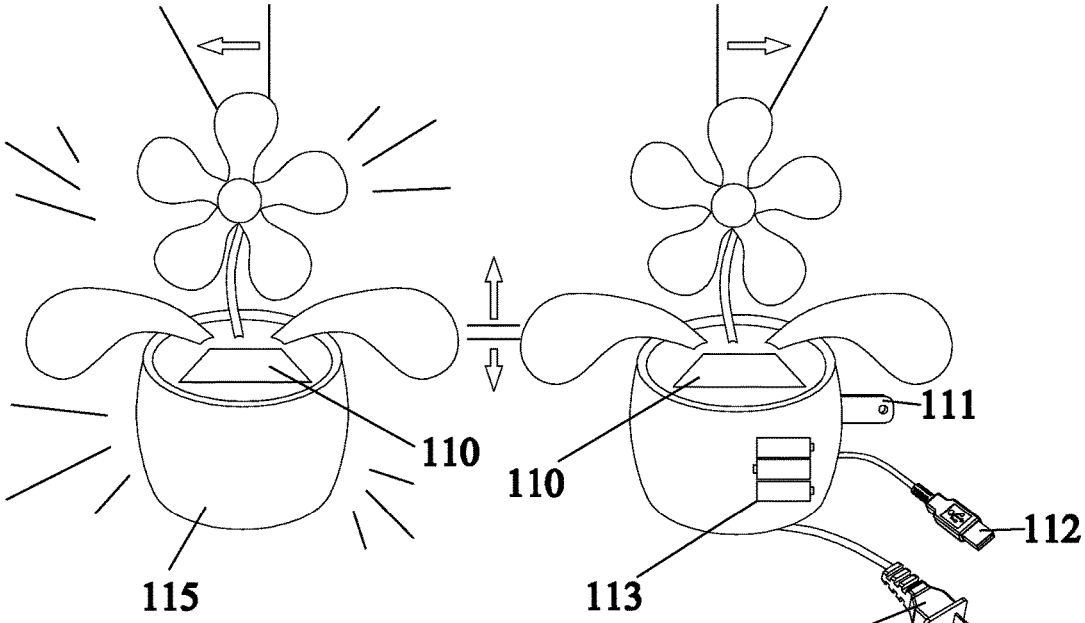
FIGS. 11A and 11B show a variation of the second preferred embodiment in the form of a plant with a moving flower and leaves in a vase. The device may be powered by any desired power source such as solar power, prong means to get AC power, a battery to provide DC power, a USB cable to get AC or DC power, wind power, chemical power, water power, or any energy storage or other power source.

FIGS. 11A and 11B show a third preferred embodiment in the form of a plant inside a vase which can use a similar moving, waving, shaking, or vibrating mechanism illustrated in FIGS. 9A to 9C for the character display-unit.

Figure 12A:
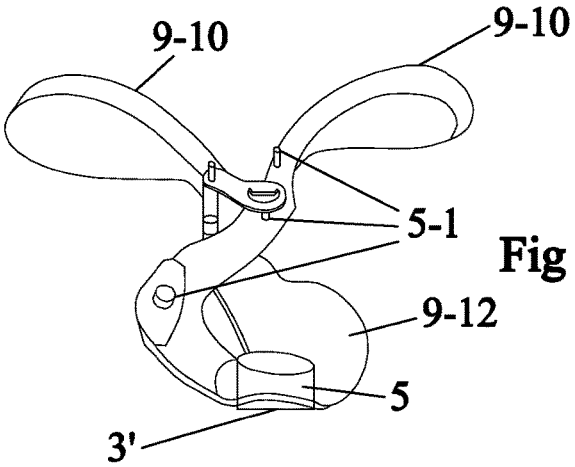
FIGS. 12A-12C show a moving pendant and related parts and accessories such as a frame, support, bar, post, injection piece(s), joint means, fixing means, holding means, fastening means, sharp tip means, range limited means, and connect means for causing parts of the device of FIGS. 11A and 11B to move in response to interaction between the magnetic-means and the electric coil-means.
Figure 12B:
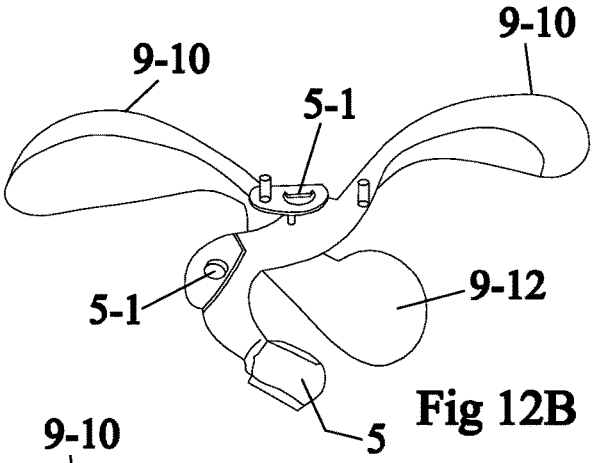
Figure 12C:
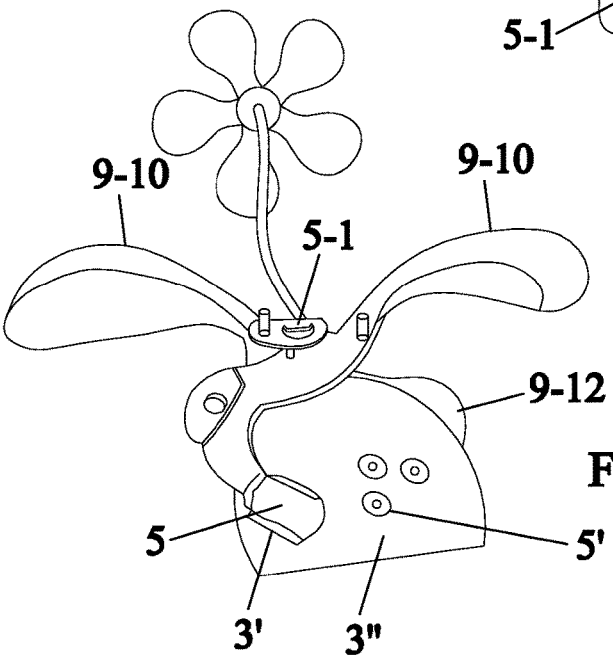

FIGS. 12A-12C show details of the construction of the third preferred embodiment, which includes two moving pendants and other parts and accessories joined together in a manner similar to that shown in FIGS. 10A-10C, with the difference being that the plant inside the vase has two separately movable leaves and one moving flower rather than two jointly moving arms and a movable head. To accomplish this, the third preferred embodiment has more than one magnetic-means on the more than one moving pendants to work with the one electric coil-means, thereby enabling more than two of the display-units to move, in contrast to the first preferred embodiment which has one moving piece and the second preferred embodiment which has two moving parts.

Figure 13A:
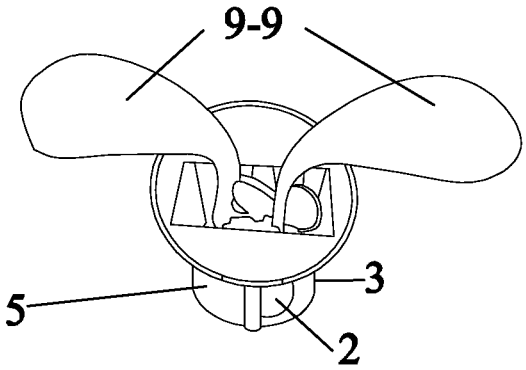
FIGS. 13A-13C show further construction details of the variation of the second preferred embodiment illustrated in FIGS. 11A, 11B, and 12A to 12C.
Figure 13B:
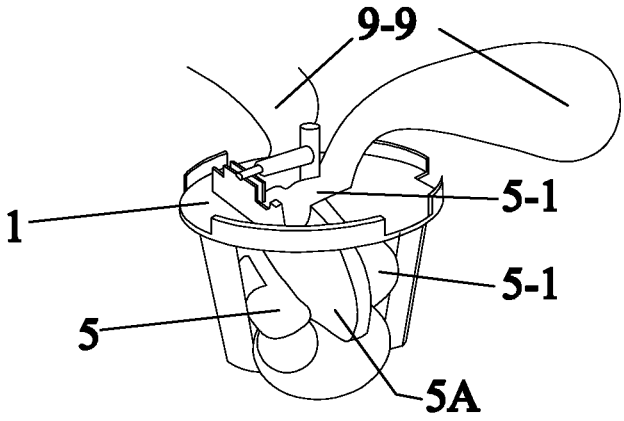
Figure 13C:
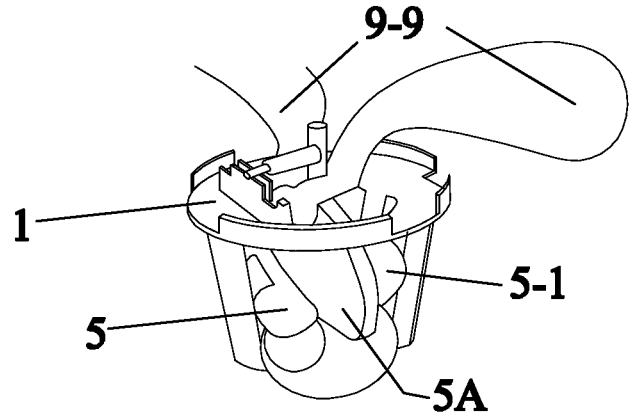

FIGS. 13A-13C show further details of the three moving parts construction of the third preferred embodiment. Each of the more than one moving pendants has built-in magnetic means so can drive the parts to move together. Two parts of the leaves wave and the flower shakes to provide very good eye-catching motion effects. The power source can be any available power source as discussed above. The plant inside vase for the third preferred embodiment may have, in addition to (1) built-in electric coil means and more than one magnetic means to cause at least two pendants to move, wave, shake, and vibrate, (2) at least one LED light source to project an image and/or cause at least part of the device to be illuminated as described above.

The current invention can include additional features and utilize additional principles described in the inventor's copending or issued patents including (1) more than one LED, (2) more than one optics-means, (3) interchangeable power sources, (4) and the LED projection light concepts described in, for example, the inventor's U.S. patent application Ser. Nos. 12/318,471, 12/318,470, 12/834,435, 12/292,153 (now U.S. Pat. No. 7,871,192), Ser. No. 12/232,505 (now U.S. Pat. No. 7,832,917), Ser. No. 12/318,473 (now U.S. Pat. No. 7,832,918), Ser. No. 12/624,621 (now U.S. Pat. No. 8,303,150), Ser. No. 12/771,003 (now U.S. Pat. No. 8,408,736), Ser. No. 12/876,507 (now U.S. Pat. No. 8,083,377), Ser. Nos. 12/886,832, 12/938,564, 12/948,953, 13/021,107.

Although specific preferred embodiments of the current invention are described above, it is to be appreciated that all alternative, equivalent, same-function and/or same-skill-or-theory variations, modifications, replacements, arrangements, or constructions may still fall within the current scope of the invention.

The invention claimed is:

1. An LED light device, comprising:

at least one LED arranged as a light source for emitting visible light beams;

at least one electric coil arranged to create a magnetic field when electric current passes through a conductive wire of the at least one electric coil;

at least one magnetic element arranged to magnetically interact with the magnetic field created by the at least one electric coil; and a pendant, magnetic element, and electric coil are included in a magnetic assembly constructed as a balance scale with an optics lens on one side, wherein the magnetic element is arranged to move up and down in response to the magnetic interaction between the at least one electric coil and the magnetic element when a variable electric signal is applied to the electric coil, wherein the pendant is arranged to move in response to the movement of the magnetic element and cause moving, waving, shaking, or vibration, relative to the at least one LED, of at least one of:

(a) the optics lens, which is fixed to the pendant on said one side of the magnetic assembly constructed as a balance scale, wherein the visible light beams from the at least one LED pass through the optics lens and are projected to form an illuminated image on a non-moving surface, and movement, waving, shaking, or vibration of the optics lens relative to the at least one LED in response to movement of the pendant causes said projected image formed on said non-moving surface to vary; and (b) at least one movable member having a desired shape, and/or texture and/or design of at least part of a character.

2. An LED light device as claimed in claim 1, wherein the pendant is arranged to cause moving, waving, shaking, or vibration of the lens fixed to the pendant.

3. An LED light device as claimed in claim 2, wherein the LED light device includes a housing having an opening, and the light beams are projected through the opening to a non-moving surface of the housing.

4. An LED light device as claimed in claim 3, wherein the LED light device simulates a candle, and the projected image varies in response to movement of the pendant to simulate a flame blowing in the wind.

5. An LED light device as claimed in claim 2, wherein the LED light device includes a housing having an opening, and the light beams passing through the moving optics lens are projected through the opening to the non-moving surface outside the housing.

6. An LED light device as claimed in claim 2, wherein the moving surface is one of a floor, ceiling, and wall.

7. An LED light device as claimed in claim 2, further comprising at least one additional LED arranged to illuminate a housing of the LED light device.

8. An LED light device as claimed in claim 2, wherein the LED light device further includes power supply elements for supplying electricity to the at least one electric coil and to the at least one LED, the power source elements including at least one of an electrical prong, a transformer, an adaptor, a USB connector, at least one battery, a solar power source, an AC power source, a DC power source, and interchangeable AC and DC power sources.

9. An LED light device as claimed in claim 1, wherein the light device further includes parts and accessories of at least one of the following light devices: a night light, an accent light, a glowing character light, a display light, a countdown night light, a motion sensor light, a Bluetooth light, a remote control light, a WiFi light device, an Internet light device, and a power fail light.

10. An LED light device as claimed in claim 1, wherein the LED light device is one of a plug-in light device, a desk top light device, and a window hanging light device.

11. An LED light device as claimed in claim 1, wherein the projected image includes at least one of a message, data, logo, time, art, and geometric shape, and wherein the projected image is formed by light from the at least one LED passing through, being blocked, or being diffracted by one or more of the following: transparent areas, light blocking elements, openings, cut outs, textured pieces, injection pieces, a lens assembly, a hologram, a laser-created element, a lenticular element, a grating film, a kaleidoscopic element, a projection element, a focus adjust component, an Lcos component, a screen, a display, a digital data device, a magnifying element, and an optical element.

12. An LED light device as claimed in claim 1, further comprising at least one of the following additional function devices: a speaker, an audio device, a video device, a camera device, a recording device, a sensor, a switch, a remote control device, a Bluetooth device, a power device, at least one AC outlet, at least one USB charger, a digital data storage device, a memory card device, an energy storage device, a power fail light device, a water lighting device, a light show device, and a communication device.

13. An LED light device as claimed in claim 1, wherein the pendant is arranged to cause moving, waving, shaking, or vibration of said at least one body part of the LED light device, and light beams from the at least one LED are projected to a surface outside the LED light device and/or are arranged to pass through a housing of the LED light device.

14. An LED light device as claimed in claim 13, wherein the pendant is arranged to cause moving, waving, shaking, or vibration of at least two body parts of the LED light device.

15. An LED light device as claimed in claim 13, further comprising a second pendant for moving, waving, shaking, or vibration of a third body part.

16. An LED light device as claimed in claim 15, wherein the at least two body parts include arms and a head of said character.

17. An LED light device as claimed in claim 13, wherein the at least two body parts are body parts of said character.

18. An LED light device as claimed in claim 13, wherein the at least one LED is arranged to project an image to a surface or to illuminate a housing of the light device.

19. An LED light device as claimed in claim 18, further comprising additional device for providing the LED light device with functions in addition to moving body parts and image projection of housing illumination.

* * * * *